US005544866A

United States Patent [19]

Dye

[11] Patent Number: 5,544,866

[45] Date of Patent: Aug. 13, 1996

[54] HANDRAIL ASSEMBLY

[76] Inventor: Robert Dye, P.O. Box 305, Medford, Oreg. 97501

[21] Appl. No.: 350,121

[22] Filed: Nov. 29, 1994

[51] Int. Cl.[6] ..... E04H 17/14

[52] U.S. Cl. ..... 256/69; 52/712; 403/230; 256/59; 256/65; 256/68

[58] Field of Search ..... 52/712; 256/68, 256/69, 65, 59; 403/230; D25/119, 121; D8/363

[56] References Cited

U.S. PATENT DOCUMENTS 3,756,567 9/1973 Murdock ..... 256/65 X
3,918,686 11/1975 Knott et al. ..... 256/65 X

*Primary Examiner*—Carl D. Friedman
*Assistant Examiner*—W. Glenn Edwards
*Attorney, Agent, or Firm*—Jacobson, Price, Holman & Stern, PLLC

[57] ABSTRACT

A specialized metal bracket permits the installation of wooden handrails between two upright supporting surfaces, such as posts, walls and the like, so that the bracket is not visible from the sides of the handrail. The bracket is L-shaped and recessed into the handrail on a side surface and bottom surface of the handrail. Two holes in a vertically-extending portion of the bracket are drilled adjacent to a bend in the bracket to permit trimming of a height of the bracket, as necessary. Two holes in the horizontally-extending portion of the bracket are spaced from the bend of the bracket to provide clearance from a post to facilitate use of a screwdriver to secure the handrail to the bracket. Both sets of holes are counter-sunk from opposite surfaces of the bracket so that the screws extending vertically into the handrail will not conflict with the screws extending horizontally into a post. Further, the counter-sunk holes provide for a snug fitting of the bracket into the handrail to aid in hiding the bracket from view from the sides of the handrail and rigidifying the connection of the handrail to support surface.

18 Claims, 1 Drawing Sheet

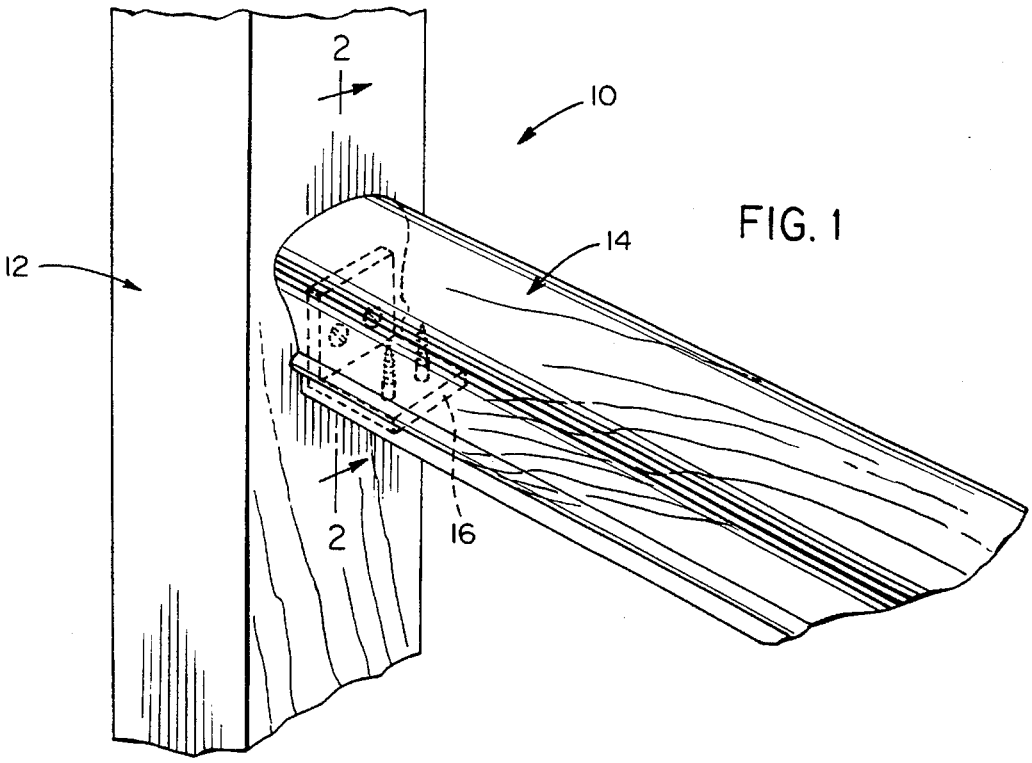
FIG. 1
FIG. 2
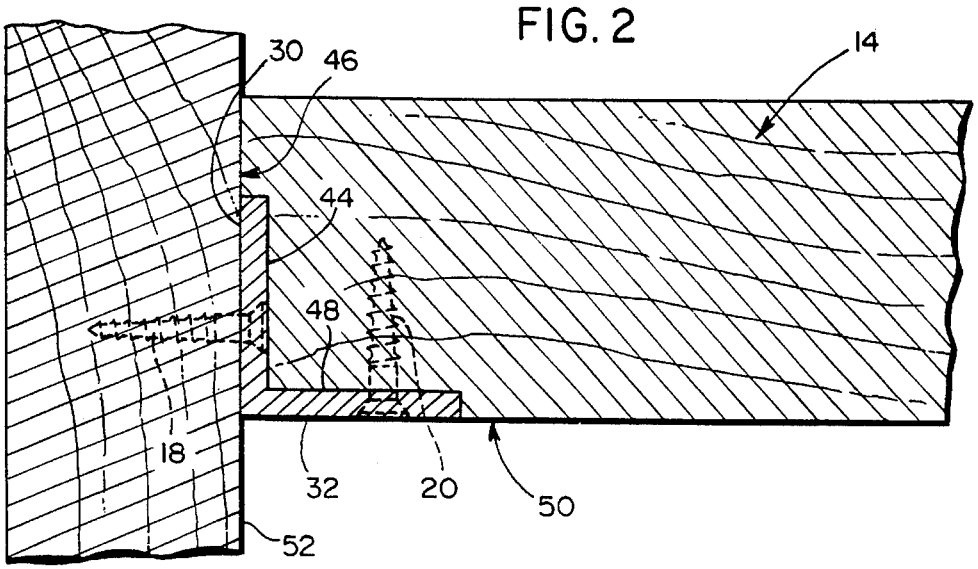
FIG. 3
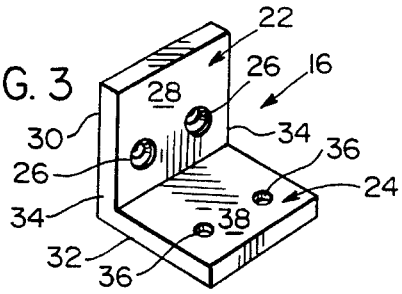
FIG. 4
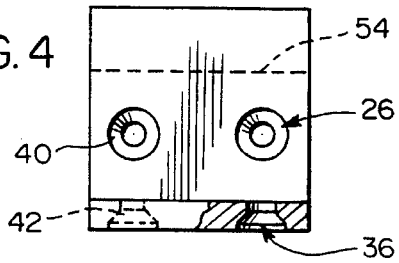

HANDRAIL ASSEMBLY

FIELD OF THE INVENTION

The present invention relates to a handrail bracket for rapid installation of a wooden handrail between two upright posts so that the bracket is not visible from the sides of the handrail and serves to rigidify the installation.

BACKGROUND OF THE INVENTION

One of the present methods for attaching a handrail includes the use of an ordinary L-shaped bracket. In use, the L-shaped bracket is visible from the sides of the handrail at a location between the wall and the handrail as well as projecting below a bottom surface of the handrail. An alternative method of attaching a handrail to a post includes an internal bolt which is difficult to use. An example of the use of an internal bolt is described in an instruction brochure for a Rail Bolt distributed by L. J. Smith of Bowerston, Ohio.

Examples of some furniture, shelving and rail connectors are disclosed in U.S. Pat. No. 875,226 to Wallace, U.S. Pat. No. 3,113,358 to Zell et al., U.S. Pat. No. 4,360,285 to Magness, U.S. Pat. No. 4,383,397 to Ward, and U.S. Pat. No. 4,639,161 to Mazaki. The prior art, however, fails to disclose a simple, yet useful, bracket for connecting a handrail to a newel post or wall which can facilitate the rapid connection of the rail end to the post or wall and at the same time rigidify the connection.

SUMMARY OF THE INVENTION

By the present invention, a specialized metal bracket permits the rapid installation of wooden handrails between two facing support structures, such as two upright posts or walls or post and walls, so that the bracket is not visible from the sides of the handrail, while at the same time rigidifying the connection between the rail end and the support structure. The bracket is L-shaped and recessed into the handrail on the end surface and bottom surface of the handrail.

Two holes in a vertically-extending portion of the bracket are drilled adjacent to a bend in the bracket to permit trimming of a height of the bracket, as necessary. Two holes in the horizontally-extending portion of the bracket are spaced from the bend of the bracket to provide clearance from a post to facilitate use of a screwdriver to secure a handrail to the bracket.

Both sets of holes are counter-sunk from opposite surfaces of the bracket so that the screws extending vertically into the handrail will not conflict with the screws extending horizontally into a post. Further, the counter-sunk holes provide for a snug fitting of the bracket into the handrail to aid in hiding the bracket from view from the sides of the handrail and aiding in the reinforcement.

Accordingly, it is an object of the present invention to provide a metal L-shaped bracket specifically for attaching a wooden handrail end to a vertical support surface, such as on a post or wall, in which the bracket has a set of two holes located in a horizontally-extending portion of the bracket and having a set of two holes located in a vertically-extending portion of the bracket, with both sets of holes counter-sunk from opposite surfaces of the bracket.

It is another object of the present invention to provide an L-shaped wooden handrail supporting bracket having a set of two holes located in a horizontally-extending portion of the bracket and having a set of two holes located in a vertically-extending portion of the bracket, with both sets of holes counter-sunk from opposite surfaces of the bracket in combination with a handrail including a recess on a terminal vertical end surface and an adjacent lower horizontal surface for recessing of the bracket into the handrail so that the bracket is not visible from sides of the handrail and serves to reinforce the mounting of the handrail to the support surface.

It is yet another object of the present invention to provide an L-shaped wooden handrail supporting bracket having a set of two holes located in a horizontally-extending portion of the bracket and having a set of two holes located in a vertically-extending portion of the bracket with both sets of holes counter-sunk from opposite surfaces of the bracket with the set of holes in the vertically-extending portion of the bracket being located closer to the bend in the bracket than the set of holes in the horizontally-extending portion of the bracket.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a handrail attached to a post by a preferred handrail bracket in accordance with the present invention.

FIG. 2 is a sectional view taken along line 2—2 of FIG. 1.

FIG. 3 is a perspective view of the preferred handrail bracket of the present invention.

FIG. 4 is an elevational view of the preferred handrail bracket, including a dotted line representing a possible cutline for removing a portion of a vertically-extending portion of the handrail bracket.

DETAILED DESCRIPTION OF THE PREFERRED EMBODIMENT

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 and 2, in particular, a handrail assembly embodying the teachings of the subject invention is generally designated as 10. With reference to its orientation in FIG. 1, the handrail assembly includes a support post 12, a handrail 14, and a handrail bracket 16. The handrail bracket 16 is secured to the post 12 by securing means such as two screws 18. The bracket 16 is secured to the handrail by securing means such as two screws 20.

The handrail bracket 16 as shown in FIG. 3 is formed of a single metal plate, such as steel, or the like, preferably about three inches long by about one-and-a-half inches wide. The plate is bent at an angle of preferably 90° along an approximate midline to form a vertically-rising portion 22 and a horizontally-extending portion 24. The vertically-rising portion 22 preferably includes two screw holes 26 which are counter-sunk from side surface 28 towards an opposite side surface 30 of the bracket. The screw holes are preferably spaced approximately ⅝ inch, on center, above bottom surface 32 of horizontally-extending portion 24. Each hole 26 is spaced inwardly from side edges 34 preferably by about 5/16 inch, on center. If desired, more than two screw holes can be used and the spacing can be adjusted as needed. However, the holes should be countersunk as described.

The horizontally-extending portion 24 also preferably includes two screw holes 36 which are counter-sunk from bottom surface 32 towards upper surface 38 of the horizontally-extending portion 24. The screw holes 36 are located preferably about one inch, on center, from surface 30 of portion 22 and are spaced inwardly preferably about 5/16 inch, on center, from side edges 34. Again, if desired, more than two screw holes can be used and the spacing can be adjusted as needed. However, the holes should be countersunk as described.

With reference to FIG. 4, the screw holes 26 and 36 are each counter-sunk to have a preferred diameter of about ⅜ inch at surfaces 28 and 38, respectively. The holes 26, 36 include conically-tapering surfaces 40, 42, respectively, which taper down to preferably about a 7/32 inch diameter opening at surfaces 30, 38, respectively.

In use, the handrail 14, to be secured to a supporting surface, such as post 12, is made of wood. An area 44 extending from terminal vertical surface 46 at the end of handrail 14 is cut away to a size to receive the portion 22 of the bracket 16. In addition, an area 48 of a size to accommodate portion 24 of bracket 16 is cut away from lowermost horizontal surface 50 of the handrail 14. The areas 44 and 48 are of sufficient depth to completely recess the bracket 16 into the handrail 14 so that surface 32 of portion 24 is continuous with surface 50 and surface 30 of portion 22 is continuous with surface 46 of the handrail 14.

To install the handrail 14, the screws 18 are screwed through holes 26 into post 12 to mount surface 30 of bracket 16 onto flat surface 52 of the post 12. The heads of the screws 18 fit within the counter-sunk portions of screw holes 26 to recess the screwheads below the surface 28 of the portion 22. The handrail 14 is then fitted onto the bracket 16 so that the recessed areas 44 and 48 hide the bracket from a side view of the handrail as shown in FIGS. 1 and 2.

Screws 20 are then passer, rough screw holes 36 from bottom surface 32 of bracket 16 and screwed into handrail 14 to secure the handrail onto the bracket 16. The screw holes 36 are preferably spaced approximately one inch away from the surface 52 of the post to allow access for a screwdriver whether of a manual or motorized type. The use of at least two screws 18 and 20 prevents the handrail 14 from being twisted off of the post 12 and from the handrail bracket 16.

If a handrail of a lesser height than the handrail 14 shown in FIG. 2 is used, a section of portion 22 of bracket 16 is removed along dotted cutline 54 as shown in FIG. 4, for example, so as to reduce the overall height of the bracket 16 to accommodate a different-sized handrail. By the positioning of the screw holes 26 adjacent to the center bend of the bracket 16, a portion of portion 22 of bracket 16 is easily removed with a hacksaw, for example.

Alternatively, it is also possible to further recess the bracket 16 into the handrail 14 by removing more wood from handrail 14 than recessed area 48. The bottom surface 32 of portion 24 is then covered with a piece of wood matching the handrail 14 to completely conceal the bracket from view from the side as well as a bottom view of the handrail.

It is also possible to use the present invention on inclined handrails. In this embodiment the recess area 48 for the portion 24 of the bracket would be cut away sufficiently deep to accommodate a horizontally-extending portion 24 of the bracket 16.

According to this invention, the metal attaching bracket also serves to reinforce the connection between the handrail end and the supporting surface. By attaching the vertically-rising portion 22 to the vertical supporting surface with countersunk screws and the fitting 32 into a recess 44 in the handrail end so that the end abuts snugly to the support surface and then attaching the horizontally-extending portion 24 into a recess 48 on the underneath side of the handrail end, a secure and rigid, abutting connection is achieved.

Having described the invention, many other modifications thereto will become apparent to those skilled in the art to which it pertains without deviation from the spirit of the invention as defined by the scope of the appended claims.

I claim:

1. A handrail assembly comprising:

a substantially vertical supporting surface, an L-shaped bracket secured to said supporting surface, and a handrail having an L-shaped recessed area at an end surface and a bottom end surface, said bracket being located in said recessed area and secured to said handrail by at least one screw extending upwardly through said bracket and into said handrail so that said bracket is blocked by said handrail from being viewed from either side of said handrail.

2. A handrail assembly according to claim 1, wherein there are two screws for securing said bracket to said vertical supporting surface.

3. A handrail assembly according to claim 2, wherein there are another two screws for securing said bracket to said handrail.

4. A handrail assembly according to claim 1, wherein said bracket includes a bend dividing said bracket into two portions with one of said two portions having two holes closer to said bend than two holes in the other of said two portions.

5. A handrail assembly according to claim 4, wherein said bracket includes an inner surface and an outer surface and said two holes of said one of said two portions are counter-sunk in a direction from said inner surface towards said outer surface and said two holes of said other of said two portions are counter-sunk in a direction from said outer surface towards said inner surface.

6. A handrail assembly according to claim 4, wherein said bend is centrally located.

7. A handrail assembly according to claim 1, wherein said bottom end surface of said bracket is continuous with a lowermost surface of said handrail.

8. A handrail assembly according to claim 6, wherein said two portions extend from each other at an angle of substantially 90°.

9. A handrail assembly according to claim 1, wherein said bracket is a single piece of material.

10. A handrail assembly comprising:

a post, a handrail, an L-shaped bracket having two portions extending substantially perpendicular to each other, at least one screw for securing said bracket to said post and at least one screw extending upwardly through said bracket and into said handrail forsecuring said bracket to said handrail, each of said two portions having at least one hole for receipt of said at least one screw for securing said bracket to said post and for receipt of said at least one screw for securing said bracket to said handrail, one of said two portions being recessed completely in one end of said handrail and said one of said two portions and said one end of said handrail contacting said post, and the other of said two portions being recessed completely in said handrail.

11. A handrail assembly according to claim 10, wherein said at least one hole in said one portion is located closer to said other portion than said at least one hole in said other portion is located to said one portion.

12. A handrail assembly according to claim 10, wherein said bracket includes an inner surface and an outer surface and said at least one hole of said one of said two portions is counter-sunk in a direction from said inner surface towards said outer surface and said at least one hole of said other of said two portions is counter-sunk in a direction from said outer surface towards said inner surface.

13. A handrail assembly according to claim 10, wherein a lowermost surface of said bracket is continuous with a lowermost surface of said handrail.

14. A handrail assembly according to claim 1, wherein said bracket is a single piece of material.

15. A handrail assembly according to claim 1, wherein said supporting surface is a wall.

16. A handrail assembly according to claim 1, wherein said supporting surface is part of a post.

17. A handrail assembly according to claim 1, wherein said handrail is wooden.

18. A handrail assembly according to claim 10, wherein said handrail is wooden.

* * * * *